US006765169B2

(12) United States Patent
Kruschke

(10) Patent No.: US 6,765,169 B2
(45) Date of Patent: Jul. 20, 2004

(54) CHAMBER COVER FIXING FOR ARC QUENCHING CHAMBERS FOR LOW VOLTAGE SWITCHGEAR

(75) Inventor: Michael Kruschke, Schwante (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/381,853

(22) PCT Filed: Jul. 20, 2001

(86) PCT No.: PCT/DE01/02806

§ 371 (c)(1),
(2), (4) Date: Mar. 28, 2003

(87) PCT Pub. No.: WO02/27741

PCT Pub. Date: Apr. 4, 2002

(65) Prior Publication Data

US 2003/0183601 A1 Oct. 2, 2003

(30) Foreign Application Priority Data

Sep. 29, 2000 (DE) ..... 100 49 726

(51) Int. Cl.[7] ..... M01M 33/02
(52) U.S. Cl. ..... 218/155; 218/156
(58) Field of Search ..... 218/157, 156, 218/148–151, 155–158, 34–38, 29, 40

(56) References Cited

U.S. PATENT DOCUMENTS

| | | | | | |
|---|---|---|---|---|---|
| 4,388,506 | A | | 6/1983 | Murai et al. | |
| 4,639,564 | A | * | 1/1987 | Grunert et al. | 218/156 |
| 4,876,424 | A | * | 10/1989 | Leone et al. | 335/202 |
| 5,756,951 | A | * | 5/1998 | Manthe et al. | 218/35 |
| 6,222,146 | B1 | * | 4/2001 | Turkmen | 218/149 |

FOREIGN PATENT DOCUMENTS

| | | |
|---|---|---|
| DE | 2544251 | 4/1977 |
| DE | 3541514 | 5/1987 |
| DE | 29612636 | 9/1997 |
| DE | 29617358 | 3/1998 |
| DE | 19709843 | 9/1998 |
| DE | 10038642 | 2/2002 |

* cited by examiner

*Primary Examiner*—Elvin Enad
*Assistant Examiner*—M. Fishman
(74) *Attorney, Agent, or Firm*—Harness, Dickey & Pierce, P.L.C.

(57) ABSTRACT

A chamber cover fixing is for arc quenching chambers for low voltage switchgears operating in air. The arc quenching chamber cover is fixed to the arch quenching chamber, by use of interlocking guide and lock elements, without the use of screws. In addition to the sliding guide elements in the arc quenching chamber housing and in the arc quenching chamber cover, one or several clips or locking grooves for engaging the clips are provided.

44 Claims, 4 Drawing Sheets

CHAMBER COVER FIXING FOR ARC QUENCHING CHAMBERS FOR LOW VOLTAGE SWITCHGEAR

This application is the national phase under 35 U.S.C. § 371 of PCT International Application No. PCT/DE01/02806 which has an International filing date of Jul. 20, 2001, which designated the United States of America and which claims priority on German Patent Application number DE 100 49 726.8 filed Sep. 29, 2000, the entire contents of which are hereby incorporated herein by reference.

FIELD OF THE INVENTION

The invention generally relates to an arc quenching chamber for low-voltage switching devices which switch in air. Preferably, it relates to one in which a quenching area is surrounded by at least one first part which is in the form of an enclosure, and by at least one second part which is in the form of an arc quenching chamber cover. Even more preferably, the two parts which surround the quenching area are provided with guide elements which can be pushed one inside the other, by which the two parts are fixed to one another in a final position perpendicular to the displacement direction and in which at least one separate attachment device, supported in the first or in the second of the parts which surround the quenching area, and one holder, which is formed on the respective other part, are provided for the separate attachment device. Using this, the two parts are fixed detachably to one another in the final position in the displacement direction.

BACKGROUND OF THE INVENTION

An arch quenching chamber such as this is known, for example, from DE-GM 296 12 636 U1. In this known arc quenching chamber, horizontal tab-like protrusions are arranged on the side walls at the outer edge of the quenching chamber enclosure, and the quenching chamber cover is provided with claw-like projections in order to clasp these protrusions when it is pushed onto the quenching chamber enclosure. In this case, a protrusion which points upwards is fitted to the upper edge of the front face of the quenching chamber in order to limit the pushing-on movement of the quenching chamber cover. A stop hole is arranged in the quenching chamber cover in such a way that the head of the attachment screw forms a stop for the wall of this stop hole, for horizontal locking of the quenching chamber cover.

Low-voltage switching devices which switch in air, such as low-voltage circuit breakers, require an arc quenching device for operation, in order to quench any arcs that occur without adversely affecting the circuit breaker itself and adjacent system parts or other assemblies. Otherwise, there would be a risk of the hot and thus ionized arc gases causing electric flashovers, or resulting in other damage.

Two fundamentally different physical forms of conventional arc quenching devices are known for low-voltage circuit breakers. Until now, for large circuit breakers, complete quenching chambers produced essentially in a conventional manner separately as a component, that is to say a robust arc-resistant, pressure-resistant and temperature-resistant enclosure, with arc splitter plates located in it and a suitable blowing apparatus have been fitted to the circuit breaker. One quenching chamber is generally provided for each pole. This chamber has a complete enclosure whose strength is matched to both the mechanical and electrical forces of the arc which occurs in it and is to be quenched, in particular with regard to the pressure and the temperature of the switching gases. The arc splitter plates are located in this chamber. The chamber may in this case be in the form of a pot-like chute into which the plates are inserted, or may be in the form of a structure composed of half shells for which an apparatus is required in order to firstly insert the plates into one half shell, then to fit the second half shell, and to finally connect the two.

As the second physical form, quenching chamber inserts are used with which only the function of actual arc quenching can be achieved in one unit. However, these structures are not able to withstand the pressure that occurs in conjunction with the arc. These inserts are therefore inserted in a chute which is provided in or on the switch enclosure. Until now, this physical form has been used predominantly for small, compact circuit breakers, but is increasingly also being used for relatively large circuit breakers, where the enclosures surround these areas, that is to say the switching area and the quenching area.

With regard to the connection to the main body of the circuit breaker, and the connection of the individual parts to one another, both types have the object of sealing the technically required gaps and joints to prevent the ionized arc gases passing through them, and of preventing electrical flashovers caused by gases which may possibly emerge despite this. To this extent, particular attention should also be paid to the connection of the quenching chamber cover to the quenching chamber enclosure.

U.S. Pat. No. 4,388,506 discloses an arc quenching chamber which is arranged removably on the circuit breaker which switches in air. For this purpose, the quenching chamber is inserted on the side of the stationary contact, by use of a hook-like projection, into a groove, and is fixed on the side of the moving switching contact with the aid of screws. In this case, the arcing chamber cover is attached to the enclosure of the quenching chamber by four screws. The hook-like projection in this switch is used for attachment of the entire quenching chamber and, furthermore and above all, for sealing against emerging ionized arc gases.

German Laid-Open Specification 35 41 514 discloses an arc quenching chamber having an attachment, which is used as a cover, for further cooling of the emerging gases. This cover is attached to the arc quenching chamber by a total of four screws. These screws pass through holes in the wall of the enclosure body of the arc quenching chamber into pockets which are open at the side and whose sizes correspond to the dimensions of the nuts which are inserted in them and in which the threads of the screws can engage. This embodiment requires not only four attachment screws but also a high degree of design and manufacturing complexity, for example for the pockets which are open at the side in order to hold the nuts.

The quenching chamber covers are also attached to the quenching chamber enclosure by four screws in other known switches, for example the 3WN6 series of switches from Siemens AG. The quenching chamber cover in this case covers a hollow projection of the quenching chamber enclosure, in which a single attachment screw is accommodated in a captive manner, by which the entire arc quenching chamber is attached to the circuit breaker. An insertion opening for a screwdriver is arranged in the quenching chamber cover. In this case as well, a relatively large number of attachment elements are required for attaching the quenching chamber cover to the quenching chamber and for attaching the quenching chamber to the enclosure of the switch.

DE-UM 296 17 358 discloses an arc quenching chamber for a low-voltage circuit breaker having a blowing damper, which can be inserted into the upper part of the enclosure of the arc quenching chamber, for cooling and deionization of arc gases which are produced during switching, and which is formed from two parts. The blowing damper is hollow and has an inner wall part, which is provided with inlet openings for the switching gases, on its inner face which faces the arc quenching chamber, and has an outer wall part, which is provided with outlet openings for the switching gases, on its outer face. In this case, the inner wall part of the blowing damper is formed integrally as a frame-like main body, and the outer wall part is formed by a separate closure plate, which is connected to the quenching chamber enclosure by a holding device. The main body of the blowing damper is inserted into the enclosure of the arc quenching chamber from above and rests on the upper edges of the arc splitter plates, by which the arc splitter plates are fixed vertically. The closure plate covers the main body of the blowing damper, and holds it firmly in position. For this purpose, it is advantageously designed to be flexible and is provided with latching tongues which engage in guide grooves provided close to the mouth of the quenching chamber enclosure.

A quenching chamber which is described in DE-A 197 09 843 has end plates with upper sprung latching elements and lower sprung latching elements which are advantageously performed integrally from the material of the plate and are produced by stamping the plate. These latching elements are arranged such that they point toward one another, that is to say the upper latching elements point downward and the lower latching elements point upward. In this case, the upper latching elements are spread apart inward in the direction of the arc splitter plates, and the lower latching elements are spread apart outward, in the direction of the enclosure of the quenching chamber.

Cutouts are provided in the enclosure of the quenching chamber in a position such that the lower latching elements of the end plate latch into these cutouts, and are supported on the upper faces of the cutouts, once they have been inserted completely into the quenching chamber. Cutouts are likewise provided in the quenching chamber cover, in a position such that the upper latching elements of the end plate latch into these cutouts and are supported on the lower faces of the cutouts when the quenching chamber cover has been inserted completely into the quenching chamber. During assembly of the quenching chamber, the end plates are inserted into the quenching chamber with the angled edges of the end plates being held by grooves in the enclosure of the quenching chamber. In the process, the arc splitter plates are inserted so far into the quenching chamber that the lower latching elements latch into the cutout in the enclosure of the quenching chamber. After this, the quenching chamber cover is pushed from above into the enclosure of the quenching chamber, which has been provided with the end plates, until the upper latching elements of the end plates latch into the cutouts in the quenching chamber cover.

In this state, the upper latching elements of the end plate are supported on the lower face of the cutout in the quenching chamber cover, and the lower latching elements are supported on the upper face of the cutout in the enclosure of the quenching chamber, by which means the material of the end plate results in a good force fit between the enclosure of the quenching chamber and the quenching chamber cover.

It has already been proposed elsewhere for the arc quenching chamber cover to be designed such that it can be fixed on the arc quenching chamber, and can be removed again, without the use of screws by means of guide and latching elements which can be pushed one inside the other.

The document DE 100 38 642 A1 thus discloses an arc quenching chamber in which the arc quenching chamber cover is mounted securely on the arc quenching chamber just by means of a latching apparatus and without any attachment screws. In this case, the latching apparatus includes an enclosure bracket which is arranged on the upper part of the front face of the arc quenching chamber enclosure, a flat projection of the arc quenching chamber cover which is provided on the side of the arc quenching chamber cover, which faces the front face of the arc quenching chamber and has a snap-action tongue which is attached to it or is integrally formed on it, is sprung, advances at an angle to the flat projection in the direction of the arc quenching chamber cover and, together with the enclosure bracket, acts as a snap-action connection in that, after being pushed through, it latches in behind it, as in insert part which is arranged on the side of the arc quenching chamber cover opposite the snap-action tongue and is preferably formed from a flat projection of the arch quenching chamber cover, and has an enclosure guide in the part of the arc quenching chamber enclosure which is opposite the enclosure bracket, into which enclosure guide the insert part of the arc quenching chamber cover can be inserted. A tool for pushing down the snap-action tongue is required in order to release the quenching chamber cover.

Furthermore, the document DE 25 44 251 discloses a low-voltage, high-power fused load disconnector, in which an arc quenching chamber cover in the form of a cover for an arc quenching chamber is integrally formed on a protective cover and is attached to the protective cover by means of a snap-action connection in the form of latching hooks which are integrally formed on the cover.

The two last-mentioned embodiments are dependent on the use of a specific sprung material for the quenching chamber cover which, it is believed, will not satisfy the material characteristics that are required overall.

Furthermore, all these cited solutions have a quenching chamber whose design is relatively complicated, with protrusions, projections and screws, as well as complex assembly since they must be matched exactly before being screwed tight. Furthermore, they are highly material-intensive.

SUMMARY OF THE INVENTION

An embodiment of the invention is based on an object of designing the attachment for the cover of the arc quenching chamber such that it can be assembled simply. It further preferably has a small number of connecting elements, such that the requirements for the connection, in particular for sealing against ionized switching gases passing through and prevention of electrical flashovers caused by any gases that emerge despite this, are satisfied.

According to an embodiment of the present invention, an object may be achieved in that the at least one separate attachment means are in the form of a spring-loaded snapper, and the holder is in the form of a latching groove with the snapper being arranged in a captive manner in the part in which it is supported.

During assembly, the arch quenching chamber cover and the enclosure are pushed one inside the other until a final position is reached. In the final position, the spring-loaded snappers latch into the correspondingly arranged latching grooves, so that the cover is firmly seated and cannot slide out. In this case, the snappers may be arranged in the enclosure of the arc quenching chamber, and the latching grooves may be arranged in the arc quenching chamber cover.

However, it may also be expedient to provide the snappers in the arc quenching chamber cover and the latching grooves in the enclosure of the arc quenching chamber.

The spring loading is preferably formed by a helical spring.

In one advantageous refinement, the snapper is a cylindrical element which has a collar as a contact point for the spring loading. In this case, the collar is used as a point of contact for the spring loading, in order to push the snapper into the latching groove. The spring loading is supported on the base of a hole, makes contact with the collar of the snapper, and pushes the latter in the direction of the latching groove.

In a further advantageous refinement, the snapper has a latching head. This latching head may be formed by one end of the cylindrical element.—It may be hemispherical or conical.

In a further refinement, the snapper may also have a grip part. This is particularly necessary when the snapper is arranged in the arc quenching chamber cover, and must be raised against the spring force in order to unlock it.

The latching element of the snapper may expediently be conical, with the corresponding latching groove likewise being conical. In an embodiment such as this, the arc quenching chamber cover is drawn against its stop without any play, and is adjusted correctly.

In the case of a spring-loaded snapper which is arranged in the enclosure of the arc quenching chamber and latches into a latching groove in the arc quenching chamber cover, a pushing element is expediently provided in this latching groove in order to push the snapper back against the spring loading, in order to release the lock.

Overall, the arc quenching chamber cover can be removed either by exerting force and overcoming a latching resistance or by operating the latching element itself by raising it or pushing it down, in order to disengage the latch.

BRIEF DESCRIPTION OF THE DRAWINGS

The invention will be explained in more detail in the following text, in order to assist understanding, on the basis of preferred exemplary embodiments, although these do not restrict the scope of protection.

FIG. 2 shows one possible embodiment of the solution according to the invention, with the arc quenching chamber cover not yet pushed in.

FIG. 4 shows a further possible embodiment of the solution according to the invention, with an arc quenching chamber cover which has not yet been pushed in.

FIG. 6 shows a third possible embodiment of the solution according to the invention, with an arc quenching chamber cover which has not yet been pushed in.

DETAILED DESCRIPTION OF THE PREFERRED EMBODIMENTS

Figure 1:
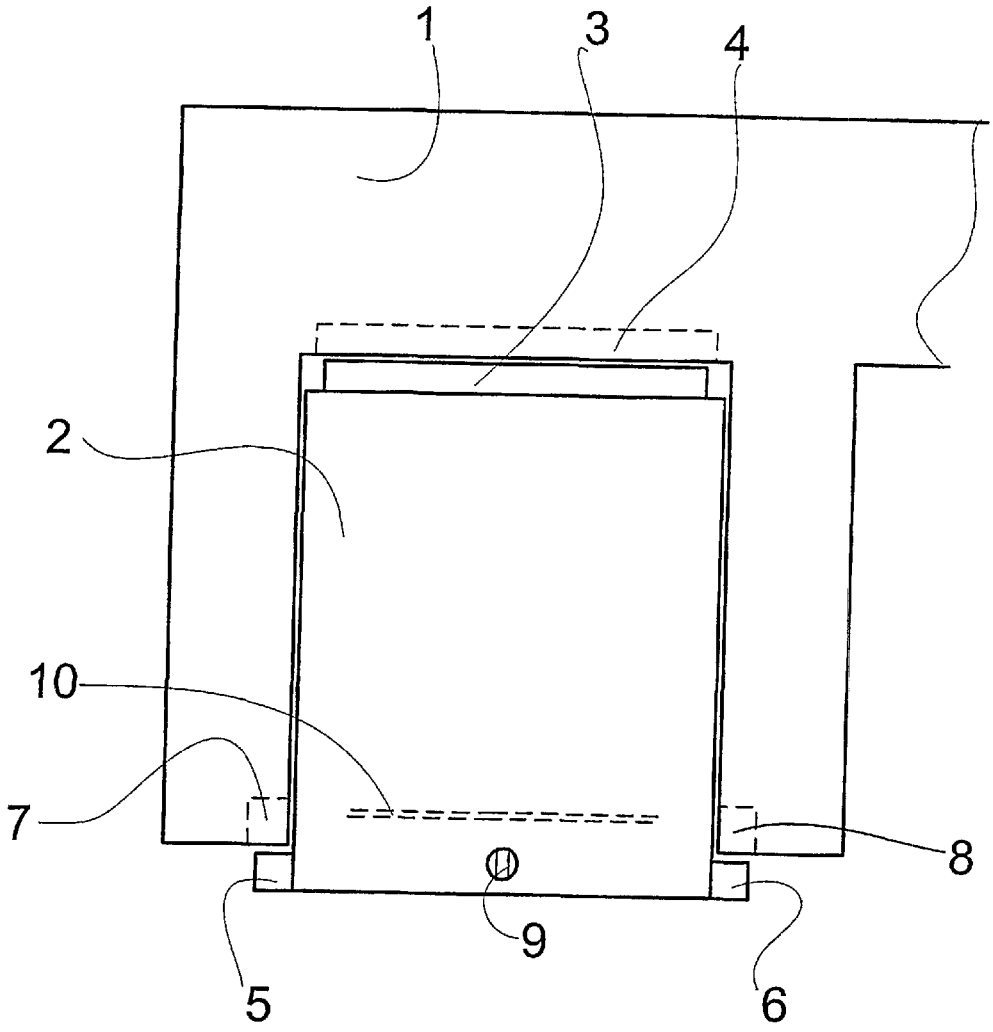
FIG. 1 shows a plan view of an arc quenching chamber in which the arc quenching chamber cover is located slightly in front of the final pushed-in position.

FIG. 1 shows a plan view of one pole of the enclosure 1 of an arc quenching chamber, in which the arc quenching chamber cover 2 is located slightly in front of the final push-in position. On its front face in the insertion direction, this has a tongue 3 which extends essentially over its entire width and can be pushed into a pocket 4 in the enclosure 1 of the arc quenching chamber, and at the opposite end has side tabs 5; 6 which, during insertion of the arc quenching chamber cover 2, enter guides 7; 8 which are provided in the enclosure 1 of the arc quenching chamber. A spring-loaded snapper 9 is provided in the arc quenching chamber cover 2 and latches into a latching groove 10 in the enclosure 1 of the arc quenching chamber when the arc quenching chamber cover 2 is in the final inserted position, in order to fix the arc quenching chamber cover 2.

Figure 2:
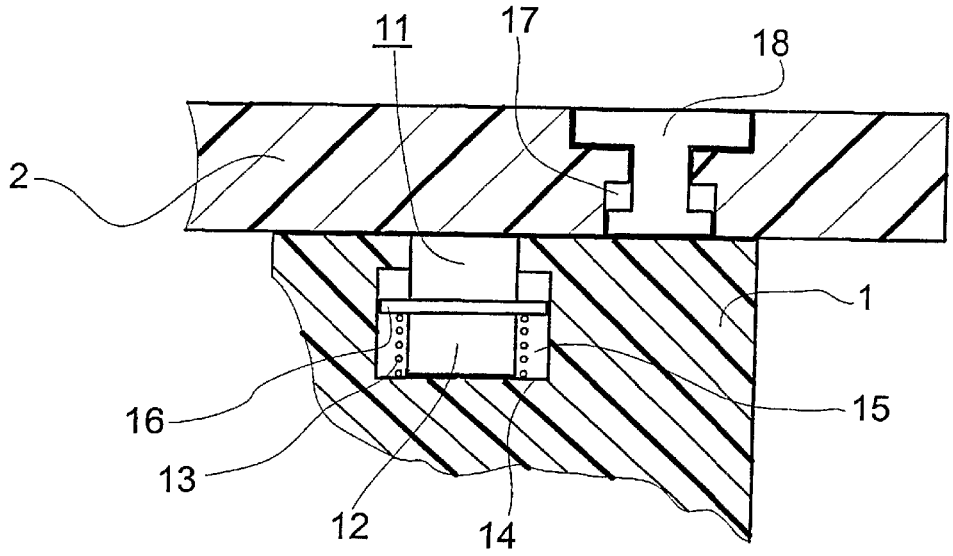

FIG. 2 shows one possible embodiment of the solution according to the invention, with an arc quenching chamber cover 2 which has not yet been pushed in. In this variant, the snapper 11 is arranged in the enclosure 1 of the arc quenching chamber. This is a cylindrical element 12, which is acted on by a helical spring 13, which is supported on the base 14 of a hole 15, makes contact with a collar 16 of the snapper 11, and presses the latter in the direction of the arc quenching chamber cover 2.

Figure 3:
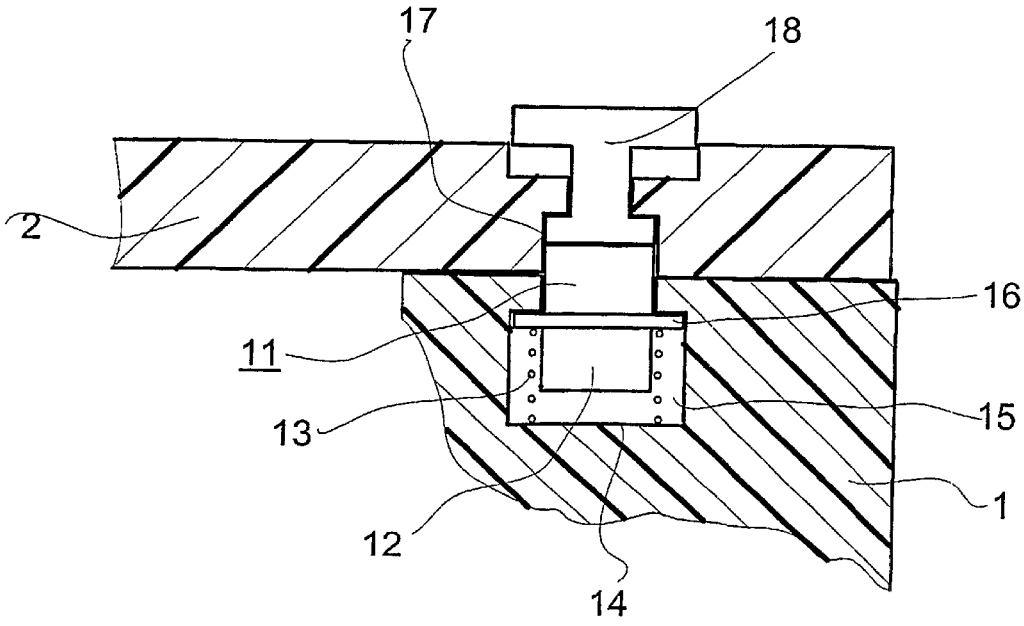
FIG. 3 shows the embodiment of the solution according to the invention as shown in FIG. 2, with an arc quenching chamber cover pushed into the final position.

FIG. 3 shows the embodiment of the solution according to the invention as shown in FIG. 2 with an arc quenching chamber cover 2 which has been pushed into the final position and in which the latching groove 17 is arranged. The snapper 11 is now pushed by the helical spring 13 into this latching groove 17, and thus locks the arc quenching chamber cover 2 in this final position. In order to make it possible to remove the arc quenching chamber cover 2 again when necessary, the latching groove 17 is provided with a pushing element 18, by which the snapper 11 can be pushed back into the hole 15 in the enclosure 1 of the arc quenching chamber, against the force of the helical spring 13. When the snapper 11 is pushed back, the arc quenching chamber cover 2 can be withdrawn and removed from its holders, the pocket 4 and the guides 7; 8, once again.

Figure 4:
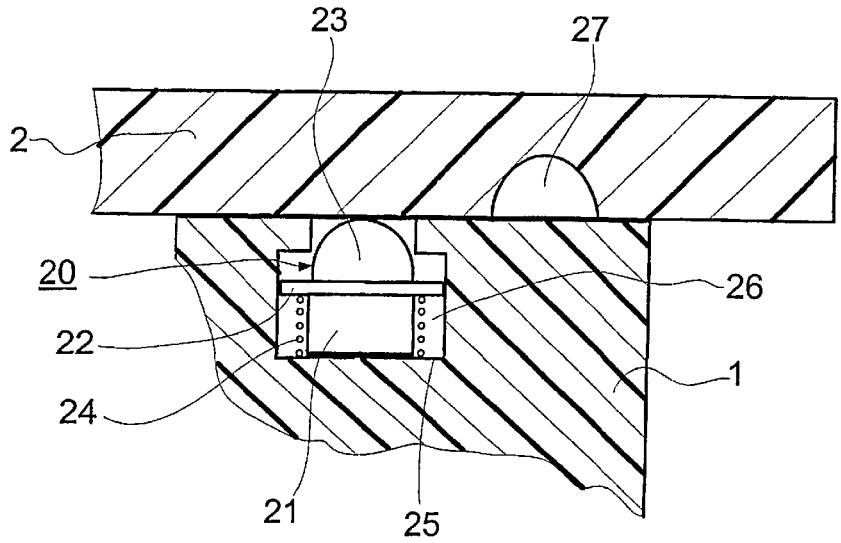
Figure 5:
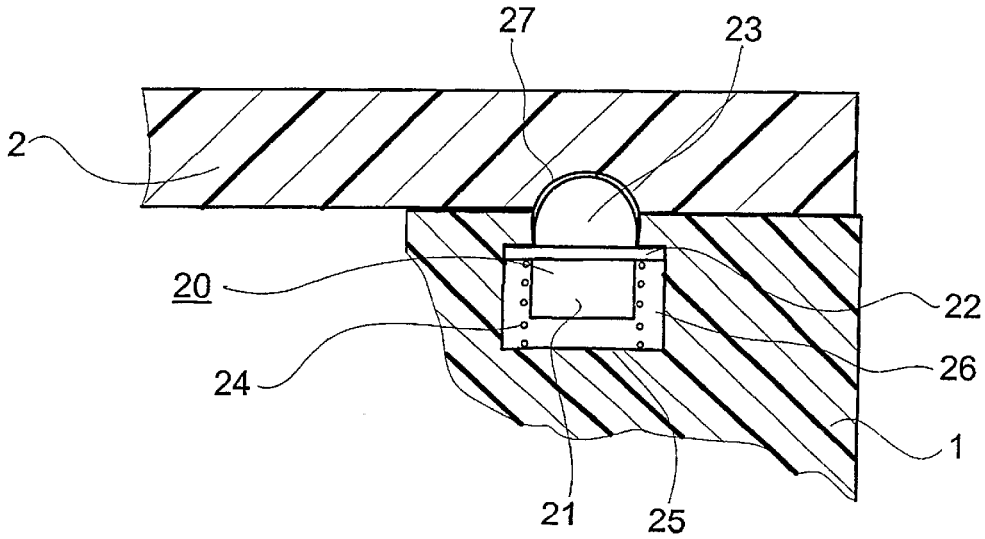
FIG. 5 shows the embodiment of the solution according to the invention as shown in FIG. 4 with an arc quenching chamber cover which has been pushed into the final position.

FIG. 4 shows one further possible embodiment of the solution according to the invention, with an arc quenching chamber cover 2 which has not yet been pushed in. In this variant, the snapper 20 is likewise arranged in the enclosure 1 of the arc quenching chamber and is in the form of a cylindrical element 21 with a collar 22 and a hemispherical latching head 23, and is acted on by a helical spring 24, which is supported on the base 25 of a hole 26, makes contact with the collar 22 of the snapper 20, and pushes the snapper 20 in the direction of the arc quenching chamber cover 2. FIG. 5 shows the embodiment of the solution according to the invention as shown in FIG. 4 with an arc quenching chamber cover 2 which has been pushed into the final position and in which the latching groove 27 is arranged. The snapper 20 is now pushed by the helical spring 24 into this latching groove 27, and thus locks the arc quenching chamber cover 2 in this final position.

In order to make it possible to remove the arc quenching chamber cover 2 once again when necessary, it is possible in this embodiment for it to be withdrawn and removed easily from its holders, the pocket 4 and the guides 7; 8. This can be done by applying appropriate force to overcome the force of the helical spring 24 acting on the spherical latching head 23, as is the case with ball-action snappers of this type which are known from other applications.

Figure 6:
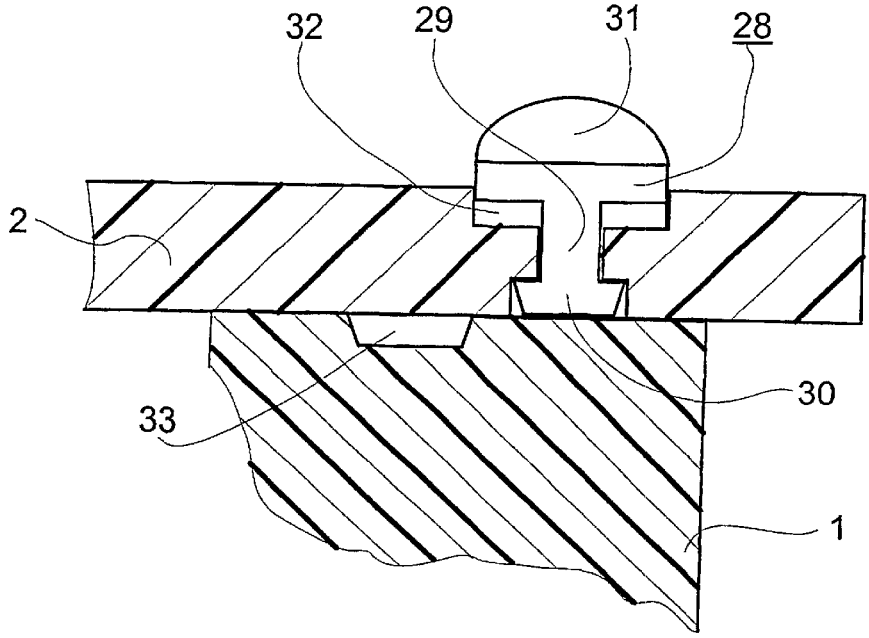

FIG. 6 shows a third possible embodiment of the solution according to the invention, with an arc quenching chamber cover 2 which has not yet been pushed in. In this variant, the snapper 28 is arranged in the arc quenching chamber cover 2 and is acted on by a spring element (which is not illustrated) in the direction of the enclosure 1 of the arc quenching chamber. The snapper 28 has a cylindrical part 29, a latching element 30 and a grip part 31. In the illustrated position, the snapper 28 is resting on the enclosure 1 of the quenching chamber and has been pushed back against the spring force into its guide 32, which is provided in the arc quenching chamber cover 2 and is matched to its shape. The latching element 30 of the snapper 28 is conical, in the same way as the latching groove 33 which is provided in the enclosure 1 of the arc quenching chamber.

Figure 7:
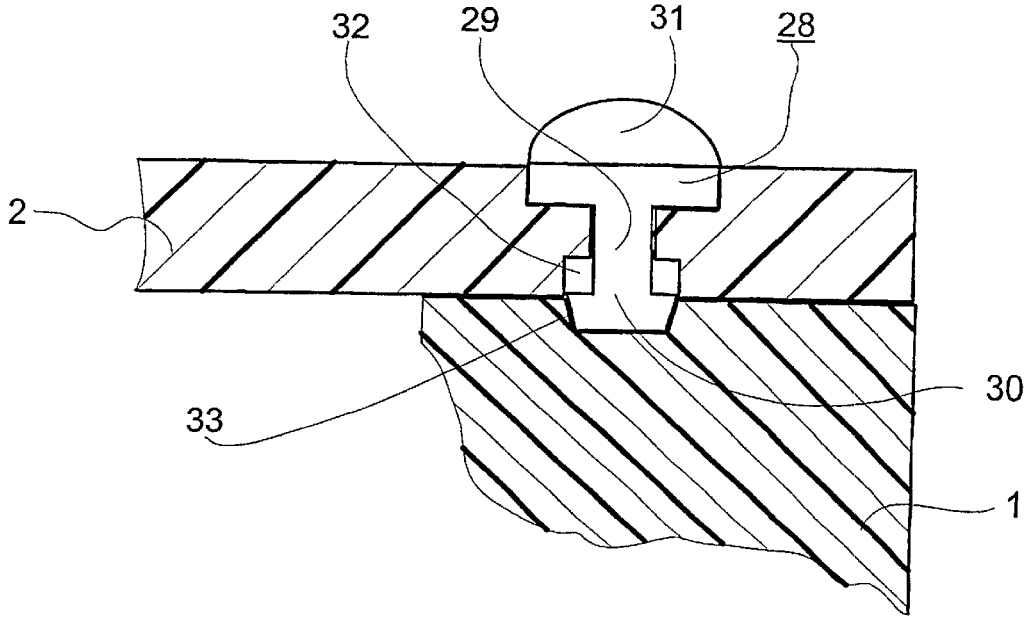
FIG. 7 shows the embodiment of the solution according to the invention as shown in FIG. 6, with an arc quenching chamber cover which has been pushed into the final position.

FIG. 7 shows the embodiment of the solution according to the invention as shown in FIG. 6 with an arc quenching chamber cover 2 which has been pushed into the final position. The snapper 28 has now been pushed by the spring element (which is not illustrated) into the latching groove 33 in the enclosure of the arc quenching chamber and fixes the arc quenching chamber cover 2 in this position without any play by virtue of the conical configuration of both the latching element 30 and of the latching groove 33. In order to make it possible to remove the arc quenching chamber cover 2 once again when necessary, the snapper 28 is gripped on its grip part 31 and is pulled out of the latching groove 33 into the guide in the arc quenching chamber cover 2, against the force of the spring element (which is not illustrated). With the snapper 28 pulled back, the arc quenching chamber cover 2 can once again be withdrawn and removed from its holders, the pocket 4 and guides 7; 8.

The advantages of the solution according to embodiments of the invention are essentially that the arc quenching chamber cover can be fit and removed by use of the spring-loaded snapper by hand without any tools, and there are no individual parts which can be lost. It is mounted securely on the arc quenching chamber without any attachment screws, just by use of a latching apparatus, and can be detached either by exerting force and overcoming a latching resistance or by operating the latching element itself, by raising or pushing down a pushing element in order to disengage the latch.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arc quenching chamber for low-voltage switching devices which switch in air, comprising:

a quenching area, surrounded by at least one first part in the form of an enclosure and by at least one second part in the form of an arc quenching chamber cover, wherein the first and second parts surrounding the quenching area include guide elements adapted to be pushed one inside the other, which fix the first and second parts to one another in a final position perpendicular to the displacement direction of the guide elements; and at least one separate attachment device, supported in at least one of the first and second of the parts surrounding the quenching area, and one holder, formed on the respective other part, wherein the two parts are fixed detachably to one another in the final position in the displacement direction, wherein the at least one separate attachment device includes a spring-loaded snapper and the holder includes a latching groove, and wherein the snapper is arranged in a captive manner in the part in which it is supported.

2. The arc quenching chamber as claimed in claim 1, wherein the spring loading is formed by a helical spring.

3. The arc quenching chamber as claimed in claim 1, wherein the snapper includes a cylindrical element, including a collar as a contact point for the spring loading.

4. The arc quenching chamber as claimed in claim 1, wherein the snapper includes a latching head.

5. The arc quenching chamber as claimed in claim 4, wherein the latching head is formed by one end of the cylindrical element.

6. The arc quenching chamber as claimed in claim 4, wherein the latching head is hemispherical.

7. The arc quenching chamber as claimed in claim 4, wherein the latching head is conical.

8. The arc quenching chamber as claimed in claim 1, wherein the snapper includes a grip part.

9. The arc quenching chamber as claimed in claim 1, wherein the latching groove is conical.

10. The arc quenching chamber as claimed in claim 1, wherein a pushing element is provided in the latching groove, in order to push back the snapper against the spring loading.

11. The arc quenching chamber as claimed in claim 2, wherein the snapper includes a cylindrical element, including a collar as a contact point for the spring loading.

12. The arc quenching chamber as claimed in claim 2, wherein the snapper includes a latching head.

13. The arc quenching chamber as claimed in claim 12, wherein the latching head is formed by one end of the cylindrical element.

14. The arc quenching chamber as claimed in claim 12, wherein the latching head is hemispherical.

15. The arc quenching chamber as claimed in claim 12, wherein the latching head is conical.

16. The arc quenching chamber as claimed in claim 3, wherein the snapper includes a latching head.

17. The arc quenching chamber as claimed in claim 16, wherein the latching head is formed by one end of the cylindrical element.

18. The arc quenching chamber as claimed in claim 16, wherein the latching head is hemispherical.

19. The arc quenching chamber as claimed in claim 16, wherein the latching head is conical.

20. The arc quenching chamber as claimed in claim 4, wherein the snapper includes a grip part.

21. The arc quenching chamber as claimed in claim 4, wherein the latching groove is conical.

22. The arc quenching chamber as claimed in claim 7, wherein the snapper includes a grip part.

23. The arc quenching chamber as claimed in claim 7, wherein the latching groove is conical.

24. The arc quenching chamber as claimed in claim 2, wherein a pushing element is provided in the latching groove, in order to push back the snapper against the spring loading.

25. The arc quenching chamber as claimed in claim 3, wherein a pushing element is provided in the latching groove, in order to push back the snapper against the spring loading.

26. The arc quenching chamber as claimed in claim 4, wherein a pushing element is provided in the latching groove, in order to push back the snapper against the spring loading.

27. An arc quenching chamber for low-voltage switching devices which switch in air, comprising:

at least one first part in the form of an enclosure; and at least one second part in the form of an arc quenching chamber cover, the at least one first and second parts surround a quenching area, wherein the at least one first and second parts include guide elements, adapted to be pushed one inside the other, which fix the first and second parts to one another in a final position perpendicular to the displacement direction of the guide elements; and at least one separate attachment device, supported in at least one of the first and second of the parts, and one holder, formed on the respective other part, wherein the two parts are detachably fixed to one another, and wherein the at least one separate attachment device includes a spring-loaded snapper and the holder includes a latching groove, the latching groove and the snapper being arranged in a captive manner in the part in which it is supported.

28. The arc quenching chamber as claimed in claim 27, wherein the snapper includes a cylindrical element, including a collar as a contact point for the spring loading.

29. The arc quenching chamber as claimed in claim 27, wherein the snapper includes a latching head.

30. The arc quenching chamber as claimed in claim 29, wherein the latching head is formed by one end of the cylindrical element.

31. The arc quenching chamber as claimed in claim 29, wherein the latching head is hemispherical.

32. The arc quenching chamber as claimed in claim 29, wherein the latching head is conical.

33. The arc quenching chamber as claimed in claim 27, wherein the snapper includes a grip part.

34. The arc quenching chamber as claimed in claim 27, wherein the latching groove is conical.

35. The arc quenching chamber as claimed in claim 27, wherein a pushing element is provided in the latching groove, in order to push back the snapper against the spring loading.

36. An arc quenching chamber cover, adapted to be removably fixed on an arc quenching chamber without the use of screws, comprising guide elements, adapted to be pushed one inside the other;

a tongue, at a front end in an insertion direction, extending in the insertion direction, wherein the tongue is adapted to be inserted into a pocket in an enclosure of the arc quenching chamber;

side tabs, at the opposite end, adapted to engage, during insertion of the arc quenching chamber cover, guides provided in the enclosure of the arc quenching chamber; and one of at least one latching groove and at least one spring loaded snapper, wherein the other of the at least one spring loaded snapper and latching groove is on the enclosure of the arc quenching chamber, the at least one latching groove being adapted to receive and hold the at least one spring loaded snapper.

37. The arc quenching chamber cover as claimed in claim 36 wherein the at least one spring loaded snapper includes a cylindrical element, including a collar as a contact point for the spring loading.

38. The arc quenching chamber cover as claimed in claim 36, wherein the at least one snapper includes a latching head.

39. The arc quenching chamber cover as claimed in claim 38, wherein the latching head is formed by one end of the cylindrical element.

40. The arc quenching chamber cover as claimed in claim 38, wherein the latching head is hemispherical.

41. The arc quenching chamber cover as claimed in claim 38, wherein the latching head is conical.

42. The arc quenching chamber cover as claimed in claim 36, wherein the at least one snapper includes a grip part.

43. The arc quenching chamber cover as claimed in claim 36, wherein the at least one latching groove is conical.

44. The arc quenching chamber cover as claimed in claim 36, wherein a pushing element is provided in the at least one latching groove, in order to push back the at least one snapper against the spring loading.

* * * * *